United States Patent [19]

Huseby et al.

[11] 4,097,292

[45] Jun. 27, 1978

[54] CORE AND MOLD MATERIALS AND DIRECTIONAL SOLIDIFICATION OF ADVANCED SUPERALLOY MATERIALS

[75] Inventors: Irvin C. Huseby, Schenectady; Frederic J. Klug, Amsterdam, both of N.Y.

[73] Assignee: General Electric Company, Schenectady, N.Y.

[21] Appl. No.: 775,759

[22] Filed: Mar. 9, 1977

[51] Int. Cl.[2] ..... B22C 9/10; B22D 21/00; B28B 7/34; C04B 35/44

[52] U.S. Cl. ..... 106/38.9; 106/65; 106/73.2; 106/73.4; 106/41; 164/132

[58] Field of Search ..... 106/73.2, 73.4, 65, 106/38.9; 423/263, 600; 164/132, 369, 41

[56] References Cited

U.S. PATENT DOCUMENTS

| | | | |
|---|---|---|---|
| 3,038,861 | 6/1962 | Van Vitert | 423/263 |
| 3,287,143 | 11/1966 | Yavorsky | 106/55 |
| 3,643,728 | 2/1972 | Hulse | 164/132 |
| 3,833,389 | 9/1974 | Komeya et al. | 106/55 |
| 3,993,844 | 11/1976 | Kiger et al. | 106/65 |
| 4,040,845 | 8/1977 | Richerson et al. | 106/73.2 |
| 4,043,377 | 8/1977 | Mazdiyasni | 164/41 |

OTHER PUBLICATIONS

Chem. Abstracts 64, item 16708d, (1966), "Phase Equilibriums in the Yttrium Oxide-Alumina System."

Chem. Abstracts 64, item 16708g, (1966), "Phase Equilibriums in the $Y_2O_3$—$Al_2O_3$—$SiO_2$ System."

*Primary Examiner*—Helen M. McCarthy

*Attorney, Agent, or Firm*—D. M. Winegar; J. T. Cohen; M. Snyder

[57] ABSTRACT

A ceramic article suitable for use in the casting of advanced superalloy materials has a structure of a predetermined porosity content and consists of either $3Y_2O_3 \cdot 5Al_2O_3$, $Y_2O_3 \cdot Al_2O_3$ or $2Y_2O_3 \cdot Al_2O_3$ or two-phase mixtures of these single-phase materials.

6 Claims, No Drawings

CORE AND MOLD MATERIALS AND DIRECTIONAL SOLIDIFICATION OF ADVANCED SUPERALLOY MATERIALS

BACKGROUND OF THE INVENTION

1. Field of the Invention

This invention relates to materials suitable for making cores employed in the casting and directional solidification of advanced superalloys such as NiTaC-13.

2. Description of the Prior Art

Advanced superalloy materials, such as NiTaC-13 and other similar metal eutectic alloys, are cast and directionally solidified at temperatures of about 1700° C and above for upwards of 30 hours exposure thereto. Therefore, cores and molds employed therewith must have high temperature strength and nonreactivity with the molten metal. That is, the mold and core material must not dissolve in the cast molten metal nor form an excessively thick interface compound with the molten metal. The cores also must be compatible with the superalloy to prevent hot tearing during solidification.

It is therefore an object of this invention to provide new and improved core and mold materials for the casting and directional solidification of superalloys.

Other objects of this invention will, in part, be obvious and will, in part, appear hereinafter.

BRIEF DESCRIPTION OF THE INVENTION

In accordance with the teachings of this invention there is provided a ceramic article useful in the casting and directional solidification of advanced superalloy materials. The material of the ceramic article consists of a single-phase material of either $3Y_2O_3 . 5Al_2O_3$, $Y_2O_3 . Al_2O_3$ or $2Y_2O_3 . Al_2O_3$ or two-phase mixtures of these single-phase materials.

The crushability characteristics are enhanced by incorporating a predetermined amount of porosity in the structure of the ceramic article. Depending upon the material and the end use of the article the porosity content may range from about 10% by volume to about 70% by volume.

DESCRIPTION OF THE INVENTION

Ceramic cores suitable for use in the casting and directional solidification of advanced superalloy materials consists of a single phase material which is either $3Y_2O_3 . Al_2O_3$, $Y_2O_3 . Al_2O_3$, $2Y_2O_3 . Al_2O_3$ or two-phase mixtures thereof. The mixtures may consist of either two or all three of the single-phase materials in any volume ratio. Preferably, the mixture is of two of the materials only, these being $3Y_2O_3 . 5Al_2O_3$ and $Y_2O_3 . Al_2O_3$ and $Y_2O_3 . Al_2O_3$ and $2Y_2O_3 . Al_2O_3$. Upon preparing the particular material for a core, it is pressed and sintered to a preferred density within a predetermined range of porosity for the desired end use. Each material compound has a coefficient of thermal expansion which is less than that of the superalloy, such as NiTaC-13, which is cast about them. Consequently, upon cooling of the cast melt, the metal is subject to hot tearing.

However, the susceptibility to hot tearing is reduced by introducing a predetermined amount of porosity into the formed ceramic. It has been discovered that the porosity content of the ceramic article may be as little as about 10 percent by volume of the article to as great as about 70 percent by volume of the article. Preferably the maximum content is about 50 percent by volume. It is desired that some of the porosity be continuous throughout so as to enhance the ability of the article to fracture and break up as the cast metal shrinks upon solidifying. A porosity content of about 10 percent by volume is necessary to assure some of the pores being interconnected. However, the degree or amount of porosity is also limited by the need of the article, or core, having a minimum integrity or strength to enable the core to be handled, placed in a mold and to withstand the initial shock and force of the melt being cast into the mold. The core must remain intact during initial solidification and yet be able to be crushed at a later time as the metal shrinks. However, the desired configuration of the cast shape is maintained throughout. In the instance of advanced superalloy materials such as NiTaC-13 directional solidification is practiced for upwards of 30 hours at temperatures in excess of about 1700° C.

Further the porous structure enhances the removal of the ceramic material from the casting after solidification. This occurs in the materials' inherent ability to permit the entry of an etching or leaching solution to penetrate into the interior regions of the core. At the same time a greater surface area of the ceramic material is available and exposed to the etching or leaching solutions thereby enabling the ceramic material removal to occur at a faster rate.

The materials are prepared in either one of three methods. A first method is to mechanically mix the proper amounts of each of the two oxides material mixture, press the material into the desired core configuration and porosity content and sinter the pressed core. A second method is to mechanically mix the proper amounts of each of the two oxides of the desired material mixture and subject the mixture to calcination. After calcining, the processed material is crushed and ground to a desired particle size. The prepared material is then pressed to the desired core configuration having a given density and sintered. A third method of preparing the material compositions is to mechanically mix the proper amounts of the oxides and then fuse-cast them by heating them close to or above their melting temperature. After fuse-casting, the mixture will consist essentially of the desired two phase material. The fused-cast material is then refined into the desired particle size of from about 10 microns to about 150 microns by suitable milling techniques such as hammer-milling, ball-milling, and the like. The desired core configurations are then prepared from this material.

Complicated shapes may be prepared from materials made by any of the above methods by employing a suitable manufacturing technique as injection molding, transfer molding, and the like.

Suitable means for removing the ceramic material of the cores from castings of advanced superalloy materials are molten salts such as molten fluoride salts and/or molten chloride salts. Such suitable salts are $M_3AlF_6$, $M_3AlF_6 + MF$, $M_3AlF_6 + M'F_2$ and $M_3AlF_6 + MCl$ wherein M is Li, Na or K and M' is Mg, Ca, Ba, or Sr.

It is important that the purity of the molten salt be maintained at a high degree so that the leaching affect of the bath is not diminished. Further, a controlled atmosphere is also desirable to prevent oxidation of the salt pot and the casting, which can introduce impurities into the salt bath or accidental failure of the pot or container. The molten salt is also agitated to help maintain its leaching effect.

The controlled atmosphere for covering the molten salt bath is one of the gases selected from the group consisting of argon, neon, hydrogen, nitrogen and helium. Suitable gases for bubbling through the molten salt bath for agitation thereof are nitrogen, forming gas (5% to 10% by volume hydrogen, balance nitrogen) and argon.

In employing the salt baths it is important that contaminants be kept from the baths to maintain their leaching effect. In particular, a stagnant inert gas atmosphere is preferred as a cover gas for the bath when the inert gas atmosphere contains too great an amount of oxygen therein. If the inert gas has an oxygen content of less than 50 ppm, then a flowing gas atmosphere can be employed. This same problem prevents the use of the inert gas as a bubbler when the oxygen content is too great. Therefore, it is preferred that the bubbler gas be of a composition of 90% nitrogen, 10% hydrogen by volume.

A preferred leaching salt bath is made of $Li_3AlF_6$ salts which has a melting temperature of 790° C. It is desirable to have either an excess of LiF or $AlF_3$ salt therein in order to maintain a stoichiometric mixture. The excess salt added depends upon how one makes up the mixture and on which side of the stoichiometric composition one desires to be.

The fluoride salts and the fluoride products from leaching are insoluble in water. Therefore a molten chloride salt bath is provided to serve as a rinse between the fluoride bath and a final water rinse. A suitable chloride rinse has been produced by employing a molten bath of NaCl, KCl and LiCl. The composition by mole percent is NaCl 9 mole percent, KCl 36 mole percent and LiCl 55 mole percent. The melting temperature of the salt rinse is 346° C, its eutectic temperature.

To determine the reactivity of different ceramic core materials with NiTaC-13, samples consisting of each compound were made by pressing and sintering. The porosity content of each sample was approximately 5 volume percent. The material was of a purity of about 99.9%. Each sample was about 2 inches in length.

The sample of $3Y_2O_3 . 5Al_2O_3$ ceramic core material was immersed in NiTaC-13 for 20 hours at 1800° C ± 10° C in an argon atmosphere. The NiTaC-13 metal was contained in a crucible made of $3Y_2O_3 . 5Al_2O_3$. This was made by mixing $Y_2O_3$ and $Al_2O_3$ powders of 99.9% + purity, isostatically pressing the mixture about a mandrel and sintering the green compact at 1800° C for 1½ hours after removal from the mandrel. After 20 hours, the NiTaC-13 was allowed to solidify in the crucible.

The sample, crucible and NiTaC-13 metal were each sectioned and examined. No evidence of an interface compound can be found between the $3Y_2O_3 . 5Al_2O_3$ material and the NiTaC-13 metal. It appears, therefore, that $3Y_2O_3 . 5Al_2O_3$ is in equilibrium with the NiTaC-13 metal. That is, there apparently is no oxidation-reduction reactions at the interface during the 20 hour exposure time.

Sessile drop tests were carried out in flowing argon with a NiTaC-13 droplet placed on the $2Y_2O_3 . Al_2O_3$ disc-shaped sample. The sample was heated to 1800° C ± 10° C where it was maintained for 1 hour. The NiTaC-13 droplet was observed to have a wetting angle of about 70°.

The free energy of formation of $3Y_2O_3 . 5Al_2O_3$, $Y_2O_3 . Al_2O_3$ and $2Y_2O_3 . Al_2O_3$ is considerably more negative than that of $Al_2O_3$. Therefore, the metal containing carbon will be considerably less susceptible to decarborization when cast in molds with cores of these mixed oxide compounds as compared to when cast in $Al_2O_3$ ceramic articles.

We claim as our invention:

1. A ceramic article useful in the casting and solidification of advanced superalloy materials consisting essentially of at least one ceramic material selected from the group consisting of $3Y_2O_3 . 5Al_2O_3$, $Y_2O_3 . Al_2O_3$ and $2Y_2O_3 . Al_2O_3$, and the article has a minimum porosity content of about 10 percent by volume.

2. The ceramic article of claim 1 wherein the porosity content is no greater than about 70 percent by volume.

3. The ceramic article of claim 2 wherein the porosity content is no greater than about 50 percent by volume.

4. The ceramic article of claim 1 wherein the material is $3Y_2O_3 . 5Al_2O_3$.

5. The ceramic article of claim 2 wherein the material is $3Y_2O_3 . 5Al_2O_3$.

6. The ceramic article of claim 3 wherein the material is $3Y_2O_3 . 5Al_2O_3$.

* * * * *